US005113749A

United States Patent [19]

Perbix

[11] Patent Number: 5,113,749

[45] Date of Patent: May 19, 1992

[54] AIR CURTAIN PRODUCING AN OUTWARD RAMPING EFFECT FOR USE WITH AN ACCESS WAY OR ENCLOSURE

[76] Inventor: Kenneth E. Perbix, 2900 Dickens La., Mound, Minn. 55364

[21] Appl. No.: 562,755

[22] Filed: Aug. 3, 1990

[51] Int. Cl.[5] ..... F24F 9/00

[52] U.S. Cl. ..... 454/193; 454/57

[58] Field of Search ..... 98/36, 115.1, 115.2, 98/115.3, 115.4

[56] References Cited

U.S. PATENT DOCUMENTS

| | | | |
|---|---|---|---|
| 2,247,892 | 7/1941 | Schneible | 98/115.1 |
| 2,935,925 | 5/1960 | D'Ooge | 98/36 |
| 3,021,776 | 2/1962 | Kennedy | 98/36 |
| 3,023,689 | 3/1962 | Kurek | 98/36 |
| 3,254,588 | 6/1966 | Truhan | 98/36 |
| 3,935,803 | 2/1976 | Bush | 98/36 |
| 4,098,616 | 7/1978 | Dorius et al. | 98/115.1 |
| 4,967,645 | 11/1990 | Mattson | 98/36 |

FOREIGN PATENT DOCUMENTS

| | | | |
|---|---|---|---|
| 0213541 | 9/1986 | Japan | 98/36 |

*Primary Examiner*—Albert J. Makay
*Assistant Examiner*—William C. Doerrler
*Attorney, Agent, or Firm*—Moore & Hansen

[57] ABSTRACT

An apparatus for producing an air curtain comprising a central opening bounded by a frame on the top, bottom, and sides which defines internal channels which fluidly communicate with one another. The bottom and sides of the frame define apertures of varying diameter proximate to the lower portion of the central opening. The apertures are arranged in an array whereby rows of apertures more closely proximate to the front edge of the central opening have diameters greater than the diameters of the apertures in rows more closely proximate to the rear edge of the central opening. Air is drawn into the channels through the apertures, and the array of apertures produces a forwardly biased pressure gradient, the result of which is to cause a stream of air being expelled downwardly from the top of the central opening to ramp or curl forwardly toward the front edge of the central opening as that stream of air traverses the central opening. This forward ramping propels airborne particles and contaminants outwardly away from the front edge of the central opening. The air drawn through the apertures is recirculated through the channels, may be filtered and heated, and is expelled downwardly through an outlet at the top of the central opening as the stream of air. The array of apertures may be reversed so that the ramping or curling is directed rearwardly. The apparatus may be utilized in an access way such as a drive-through service window, or an enclosure for instruments.

62 Claims, 5 Drawing Sheets

AIR CURTAIN PRODUCING AN OUTWARD RAMPING EFFECT FOR USE WITH AN ACCESS WAY OR ENCLOSURE

BACKGROUND OF THE INVENTION

This invention relates generally to air curtains, and particularly to a vertical air curtain producing a forward or outward ramping effect which may be used with access ways such as drive-through service windows or enclosures such as protective hoods for user-accessible electronic equipment or laboratory instruments.

Various air curtain devices are known to the art, especially for use in situations where a person requires unobstructed access to a workpiece that is kept in a sterile or contaminant free environment, and where a glove box would not be suitable. Conversely, air curtains can work to prevent the escape of chemical vapors, contaminants, or biologically active materials from an enclosure into the surrounding atmosphere, such as in negative pressure hoods. There are several representative examples of conventional air curtain devices.

U.S. Pat. No. 3,327,935 to Berlant discloses a conventional vertical air curtain which permits variable air intake and output volumes.

U.S. Pat. No. 3,408,914 to Bayern discloses a fume hood for a work bench which diverts air out through the front access port when the port is open, and through an exhaust system when the port is closed. U.S. Pat. No. 3,301,167 to Howard discloses a similar fume hood in which the air is recirculated through a sub-micron filter and blown forwardly and downwardly in a linear direction at an angle relative to the front access port and floor plate. Air which does not pass through the access port is drawn back through the perforated floor plate by the blower, and recirculated to the filter.

U.S. Pat. No. 3,356,006 to Scott discloses a clean room structure in which recirculated air is blown through a centrally located arcuate sub-micron filter. The air expelled from the arcuate filter travels linearly in an outward radial pattern to create a continuum of progressively decreasing ambient air pressure surrounding the arcuate filter. Consequently, since the ambient air pressure is greatest directly beneath the arcuate filter, air will travel away from that zone and towards the perimeter of the clean room. While air may be recirculated through vents in the floor and conduits in the walls of the clean room, the clean room may also have one or more open walls.

While suitable for complete or partial enclosures in which a positive pressure environment may be maintained within the enclosure, these devices are not effective when the enclosure itself provides a negative pressure environment, or needs to be separately ventilated. Furthermore, these devices do not mitigate against ambient air being drawn from the exterior of the enclosure into the current of recirculating air.

Also, while the types of air curtains and devices discussed above operate with both full and partial enclosures, they become ineffective in screen- or tunnel-like access ways. To any extent that they might be operational in a screen- or tunnel-like access way, they would function as a source of undirected positive pressure rather than a vertical air curtain. Consequently, while a device such as Scott '006 or Howard '167 could be modified to operate in a tunnel-like system, the tunnel would need to be relatively long, have distinct opposing ends with outwardly directed air flow, and the pressure would decrease rather than increase with proximity to the access ports. In addition, any intermediate area of the tunnel would need to maintain a balancing positive pressure environment, and would restrict ventilation of the intermediate area.

For their most effective operation, conventional air curtain devices rely on two interrelated concepts: creating a generally vertical stream of air, and creating a pressure differential on opposing sides of that stream of air with the pressure differential oriented to assist the air curtain in either excluding air (and particles or contaminants) from the controlled environment or retaining air (and contaminants or fumes) within the controlled environment. These air curtains are not effective, however, where the pressure differential between the controlled environment and the surrounding atmosphere is oriented in direct opposition to the proper functioning of the air curtain (i.e., where the desire is to exclude outside air from a negative pressure controlled environment, or retaining air within a positive pressure controlled environment.)

One particular example relates to drive-through service windows found in "fast-food" type restaurants. In these restaurants, the cooking is generally performed using large frying, grilling, or broiling surfaces which produce a great deal of smoke and spattered grease, and require a significant amount of ventilation. The blowers used to produce this ventilation create strong low pressures within the restaurant which tend to draw air, rain or snow, bugs, exhaust fumes, and oter wind-blown debris through the drive-through windows when the doors thereto are open. Restaurant employees must frequently stand by these drive-through windows for long periods of time, and are therefore exposed to those fumes and objects being drawn forcibly through the windows. In such an instance, the vertical air curtain having an outward ramping effect of this invention has proven very effective in preventing the ingress of fumes, bugs, rain and snow, and many wind-blown objects when the air curtain is mounted across the accessway of the drive-through window, while still permitting continuous access by employees working at the window.

A second example relates to precision equipment or electronic instruments found in extremely dusty environments or those contaminated by airbourne particlate materials, including grain terminals and plants where containers are filled with de-aerated powders such as titanium dioxide Many types of mechanical and electronic instruments (such as weigh scales or the central processing units controlling automated filling lines) can be very susceptible to damage by dust or other fine particulate materials which accumulate on the instruments or are drawn into their housings by cooling fans. Furthermore, heat and electrical sparks within some equipment can pose a serious threat of dust-explosions in certain very contaminated environments. However, it is also often necessary for portions of the instruments to remain readily accessible to workers operating the equipment or using the instruments in those environments. In such instances, it has proven effective to place the instrument or equipment within a partial box-like enclosure having an open front accessway, with the vertical air curtain of this invention mounted to produce an outward ramping effect across that accessway.

As such, workers can gain immediate and frequent access to an instrument without it being exposed to the contaminated environment, and while still permitting the instrument to be properly ventilated if necessary.

BRIEF SUMMARY OF THE INVENTION

It is therefore one object of this invention to design a generally vertical air curtain having a forward or outward ramping or curling effect for use with either an access way or enclosure.

It is a related object of this invention to design the above air curtain such that it may be utilized in situations such as drive-through service windows or ventilated enclosures where there is a pressure differential between the interior and exterior of a structure, the interior pressure being normally lower than the exterior pressure, but where the objective is to prevent particles or contaminants from passing through the air curtain from the exterior to the interior.

It is another object of this invention to design the above air curtain for an access way or enclosure such that the air curtain may utilize recirculated air, and such that the air being recirculated may also be filtered and temperature controlled.

It is a distinct object of this invention to design the above apparatus for producing an air curtain such that it may be utilized with an enclosure to maintain a positive pressure interior controlled environment when placed within a negative pressure external atmosphere, and maintain the sterility of that interior controlled environment.

Briefly described, the apparatus for producing an air curtain of this invention comprises a central opening bounded by a frame or walls on the top, bottom, and sides. The frame or walls define internal channels which fluidly communicate with one another. A generally vertical downward stream of air is expelled downwardly from an outlet at the top of the central opening. The bottom and side frame or walls define apertures of varying diameter proximate to the lower portion of the central opening. The apertures are arranged in an array whereby rows of apertures more closely proximate to the front edge of the central opening have diameters greater than the diameters of the apertures in rows more closely proximate to the rear edge of the central opening. Air is drawn into the channels through the apertures, and the array of apertures produces a forwardly biased pressure gradient, the result of which is to cause the stream of air being expelled downwardly at the top of the central opening to ramp or curl forwardly toward the front edge of the central opening as that stream of air traverses the central opening. This forward ramping or curling of the stream of air propels airborne particles and contaminants outwardly or away from the front edge of the central opening and prevents those particles or contaminants from entering the stream of air. The air is recirculated through the channels, and may be filtered and heated. The array of apertures may be reversed so that the ramping or curling is directed rearwardly. The apparatus may be utilized in such applications as drive-through service windows and instrument enclosures.

DESCRIPTION OF THE PREFERRED EMBODIMENTS

The method and apparatus for producing an air curtain of this invention is shown in FIGS. 1-12 as utilized in various embodiments, and is referenced generally therein by the numeral 10.

EXAMPLE 1

Drive Through Window Structure

Figures 1, 2, 3:
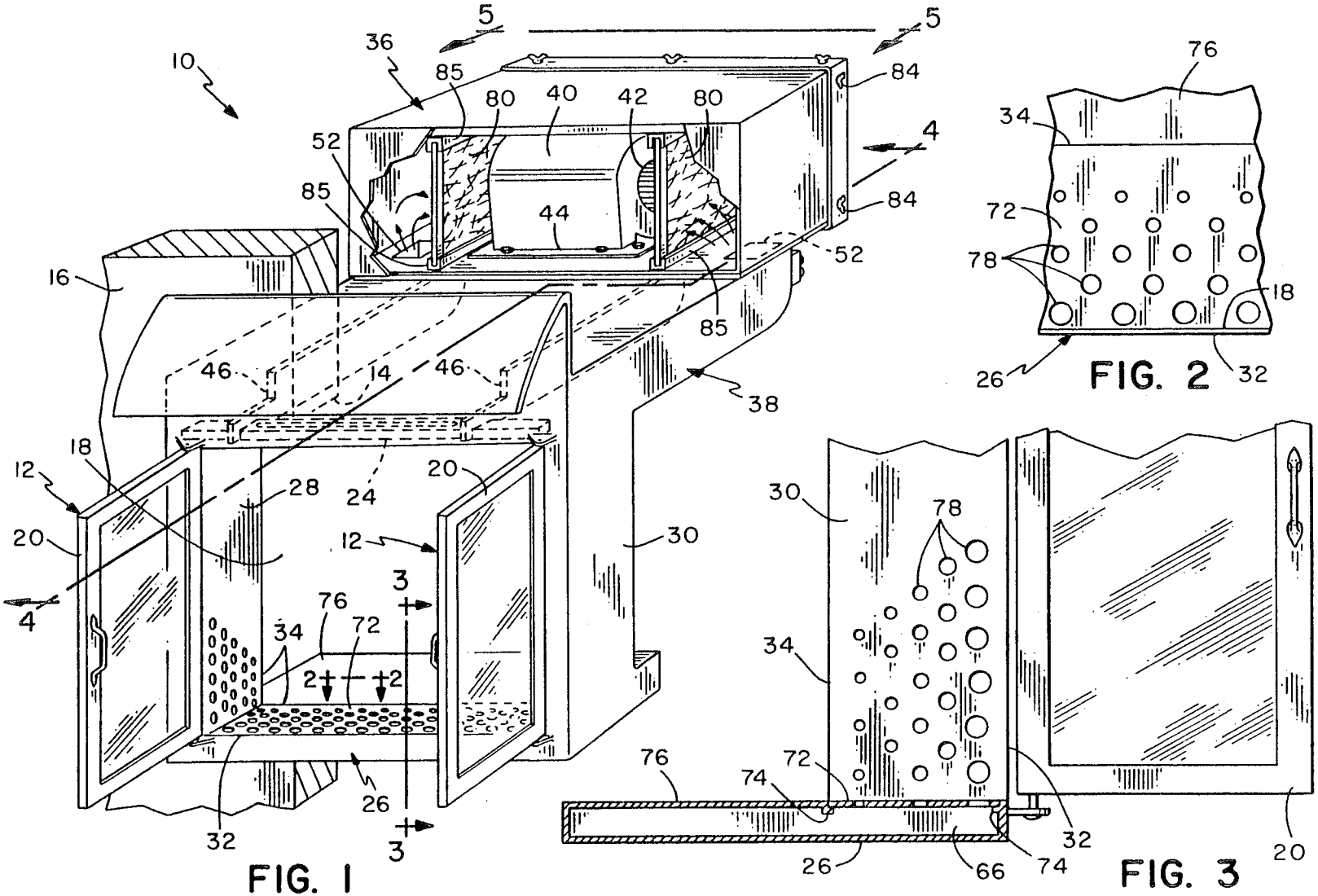
FIG. 1 is a front perspective view of the apparatus for producing an air curtain of this invention utilized in a drive-through window.
FIG. 2 is a top plan view of the bottom frame of the apparatus for producing an air curtain of FIG. 1 showing the apertures in the plate.
FIG. 3 is a partial section view of the bottom frame and one side frame of the apparatus for producing an air curtain of FIG. 1 taken through line 3—3 of FIG. 1.

Referring particularly to FIG. 1, the apparatus for producing an air curtain 10 is shown being utilized in connection with a drive-through service window structure 12 of the type commonly found in fast-food restaurants, as well as some drive-through bank teller windows, parking attendant booths, toll booths, or similar facilities.

It may be appreciated that the service window structure 12 will generally be mounted in a building which itself forms an enclosure, albeit much larger than the type of instrument enclosure discussed in Example 2, and wherein the user is disposed on the interior side of the air curtain rather than the exterior side.

The window structure 12 is mounted within a large, generally rectangular opening 14 in the wall 16 of a building, in a location confronting a traffic lane along which automobiles may pass in close proximity to the window structure 12. The window structure 12 defines a central opening 18 which may be selectively closed using a pair of pivotally mounted doors 20. Items such as foodstuff 22 may be transferred from the interior of the building wall 16 to the exterior of the building wall 16 through the central opening 18 of the window structure 12 when the doors 20 are pivoted to the open position, as shown generally in FIGS. 1 and 4.

It is understood that in some applications the apparatus for producing an air curtain 10 of this invention may be constructed to fit within an existing drive-through window structure 12, however in the preferred embodiment the apparatus for producing an air curtain 10 and the drive-through window structure 12 are incorporated into a single unitary device as shown in FIGS. 1-5. Consequently, while this description refers to components which serve dual functions (such as providing a frame for the central opening 18 as well as defining channels for recirculating air) the components of the apparatus for producing an air curtain 10 may be functionally separated from the drive-through window structure 12 without affecting the operation of the apparatus for producing an air curtain It is also understood that in some retrofit applications components of an existing or conventional drive-through window structure 12 may be utilized or modified to facilitate certain functions necessary to the operation of the apparatus for producing an air curtain 10, thereby eliminating the need to include those components separately on the apparatus for producing an air curtain 10, and further that those components of the apparatus for producing an air curtain 10 may be considered interchangeable with the drive-through window structure 12 to the extent necessary by those skilled in the art.

The central opening 18 of the drive-through window structure 12 therefore has a top frame member 24 and a bottom frame member 26 between which is measured the height of the central opening 18, a pair of opposing side frame members 28, 30 between which is measured the width of the central opening 18, and a front edge 32 and a back edge 34 between which is measured the depth of the central opening 18. The depth of the central opening 18 will generally be on the order of three inches or greater, while the height and width can vary substantially depending upon the particular application. As may be readily appreciated, the greater the height of the central opening 18, the higher the air velocity necessary to produce a suitable barrier using a generally vertical air curtain. The height of the central opening 18 may be significantly less than the overall height of the window structure 12, since the central opening 18 will generally be limited to the height of the doors 20, while the window structure 12 may extend above the doors 20 as far as is needed for the particular application.

Figure 4:
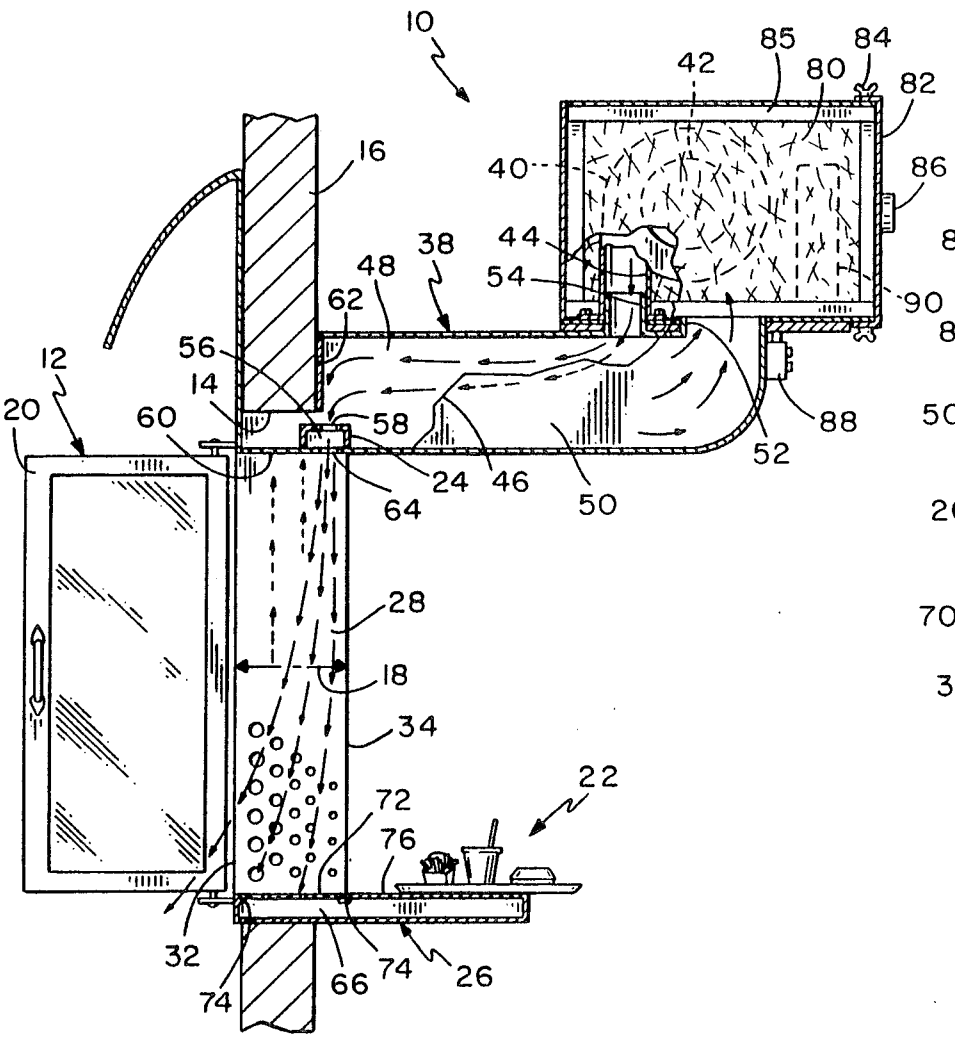
FIG. 4 is a side section view of the apparatus for producing an air curtain of FIG. 1 taken through line 4—4 of FIG. 1.

Referring to FIGS. 1 and 4, it may be seen that a generally rectangular blower housing 36 is mounted on the interior side of the wall 16. The blower housing 36 may be mounted directly to the wall 16 or a support frame (not shown), or may be supported by the duct 38 which is connected to and extends from the lower front side of the blower housing 36.

Referring particularly to FIG. 4, it may be seen that the top frame member 24 may be separate structural component contained within the duct 38, or alternately the duct 38 may be mounted above and fluidly connected to the top frame member 24 (not shown). In some applications, the bottom planar surface 60 and forwardmost horizontal wall 62 of the duct 38 may serve the same functions as the top frame member 24, in which case the forwardmost horizontal wall 62 may be positioned partially or wholly within the opening 14 of the wall 16, or be flush with the outer planar surface of the wall 16, and the bottom planar surface 60 of the duct 38 will extend forwardly at least to a point disposed within the depth of the central opening 18 whereat the air curtain is to be created. An appropriate portion of the duct 38, possibly including the bottom planar surface 60 or forwardmost horizontal wall 62, may therefore be functionally defined as the top frame member 24.

Referring again to FIGS. 1 and 4, the blower housing 36 encloses a squirrel-cage-type, forced-air blower 40 having an air intake 42 or inlet on each of the opposing sides, and a centrally disposed blower outlet 44. The blower 40 is shown herein as merely exemplary, and any suitable blower 40 of the forced-air or vacuum-intake type may be utilized as desired.

The depending blower outlet 44 of the blower 40 is operatively connected to and fluidly communicates with the interior region of the duct 38 along a centrally located portion thereof. The blower housing 36 is similarly operatively connected to and fluidly communicates with the interior region of the duct 38 along two opposing side portions thereof.

Figure 5:
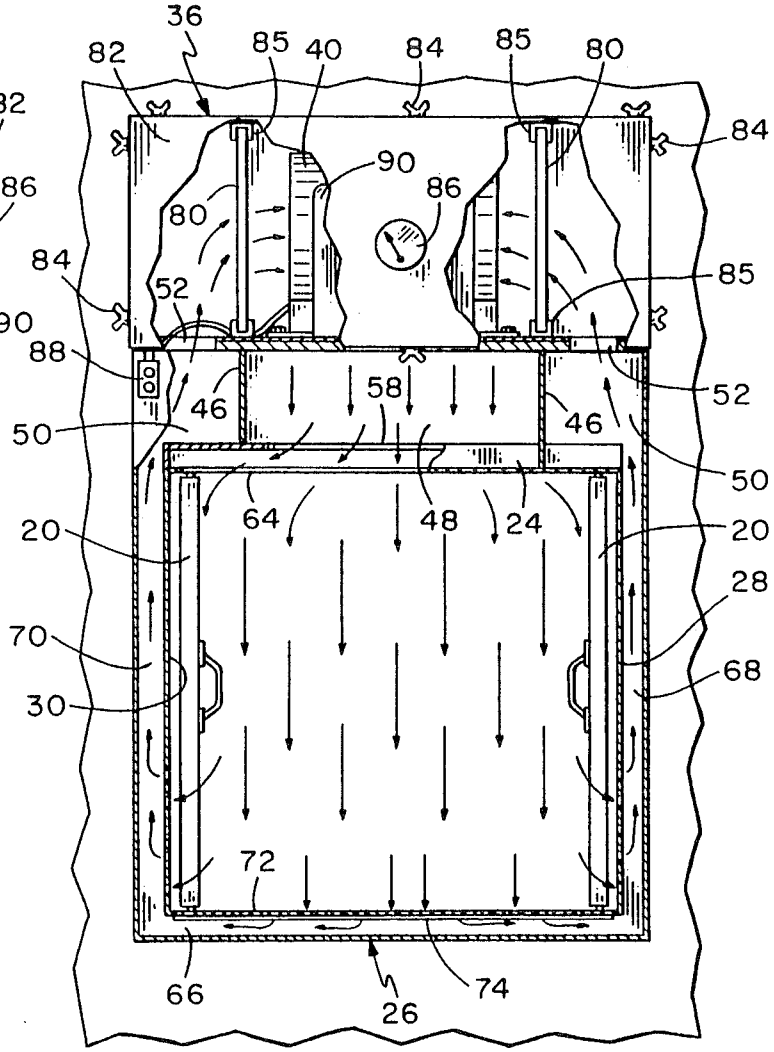
FIG. 5 is a partially broken away rear view of the apparatus for producing an air curtain of FIG. 1 taken from line 5—5 of FIG. 1.

Referring to FIGS. 1 and 5, it may be seen that a pair of partitions 46 are disposed within the interior of the duct 38 and fastened therein to divide the duct into an air flow passage 48 and a pair of air return passages 50 The air return passages 50 are each disposed on opposing sides of the air flow passage 48, and fluidly communicate with one of two opposing side openings 52 in the bottom of the blower housing 36 (or conversely, two opposing side openings 52 in the top of the duct 38 communicate with the interior region of the blower housing 36 through the open bottom thereof.) Similarly, the air flow passage 48 fluidly communicates with and is connected to the blower outlet 44 of the blower 40 through an opening and upwardly extending sleeve 54 formed in the top of the duct 38.

Air expelled from the blower 40 through the blower outlet 44 into the central interior portion of the duct 38 travels forward through the air flow passage 48 of the duct 38 to a point directly above or adjacent to the top frame member 24. The air may enter an interior channel 56 in the top frame member 24 through a top or rearwardly facing opening 58, and be forcibly expelled downward through an outlet 64 in the form of one or more slots or apertures in the bottom surface of the top frame member 24 which closely confront and face the central opening 18. The outlet 64 is constructed in any conventional manner to direct the stream of air downwardly in a generally linear vertical direction or vector, and is preferably aligned or disposed along or closely adjacent to the rear edge 34 of the central opening 18.

Referring particularly to FIGS. 2-5, it may be seen that the bottom frame member 26 defines an enclosed bottom channel 66, and the opposing side frame members 28, 30 each define an enclosed side channel 68, 70, with the bottom channel 66 connected to and fluidly communicating with each of the side channels 68, 70 at the junctures between the bottom frame member 26 and the side frame members 28, 30.

The top planar surface of the bottom frame member 26 defines a generally rectangular opening which is covered by a recessed plate 72 which is supported on rails or flanges 74 connected to and extending around the peripheral edge of the rectangular opening so that the plate 72 may be easily lifted from the bottom frame member 26 for cleaning The top surface of the recessed plate 72 is generally flush with the surrounding top surface of the bottom frame member 24 or the interior counter surface 76 so that items 22 may be slid across the interior counter surface 76 and plate 72 without catching. In most situations, it is preferable that the plate 72, interior counter surface 76, and at least the surfaces of the top frame member 24, bottom frame member 26, and the side frame members 28, 30 facing the central opening 18 be constructed either of a sanitary nickel-plated or All Clad stainless steel, with any brushed finish parallel with the path of any items 22 being transferred through the central opening 18. A plastic or stainless steel tray (not shown) may alternately be inserted beneath the plate 72 to catch any spills or small objects which might fall through or beneath the plate 72.

The plate 72 or top surface of the bottom frame member 26 and the inner surfaces of the opposing side frame members 28, 30 along the lower portions thereof each define a plurality of apertures 78 disposed within a zone generally confined between the front edge 32 and back edge 34 of the central opening 18. The central opening 18 thereby defines a lower region which is substantially bounded on its sides and bottom by a plurality of apertures 78, that lower region extending upwardly generally to the height of the highest apertures 78 along the side frame members 28, 30, but generally not above one half the height of the central opening 18. The apertures 78 may alternately be referred to as bottom apertures 78 and side apertures 78.

As may be seen particularly in FIGS. 2–5, the apertures 78 have varying diameters and are arranged or disposed in an array whereby rows of apertures 78 generally parallel with and more closely proximate to the front edge 32 of the central opening 18 have diameters greater than the diameters of the apertures 78 in rows parallel to and more closely proximate to the rear edge 34 of the central opening 18. Consequently, given a relatively constant and uniform negative pressure or draw within each of the bottom channel 66 and side channels 68, 70, a greater volume of air per unit time will tend to be drawn from the lower region of the central opening 18 through the larger apertures 78 disposed more closely proximate to the front edge 32 of the central opening 18 than is drawn through the smaller apertures 78 disposed more closely proximate to the rear edge 34 of the central opening 18.

It may be readily appreciated that the apertures 78 may be sized according to various applications, however in the example of the drive-through service window 12 the largest apertures 78 in the plate 72 should have a diameter at least slightly smaller than the smallest diameter coinage that may be transferred above the plate 72. In the United States, the largest apertures 78 in the plate 72 should therefore be slightly smaler than the diameter of a dime.

While air from the lower region of the central opening 18 will be drawn through the smaller apertures 78 at a greater velocity than through the larger apertures 78, thus causing the air pressure in the immediate vicinity of the smaller apertures 78 to be lower than in the immediate vicinity of the larger apertures 78, the greater overall rate of evacuation proximate to the front edge 32 of the central opening 18 will produce zones of progressively lower pressure or a gradient of continuously decreasing pressure as one moves from the rear edge 34 to the front edge 32 of the central opening 18 that will offset the localized Bernoulli effect near the smaller apertures 78 and pull or draw air in the lower region of the central opening 18 forwardly toward the front edge 32 of the central opening 18. This is particularly the case when considering an arbitrary unit volume of air within the lower region of the central opening 18 which is displaced more than a few inches from the bottom frame member 26 and the side frame members 28, 30. For such a unit volume of air located centrally within the central opening 18, the relative pressure differential between the interior and exterior of the building will exert a far greater force and therefore have a more perceptible impact on the movement of that air within the air curtain.

The array of increasing diameter apertures 78 will thereby produce a forwardly biased pressure gradient of progressively increasing draw rate or intensity and correspondingly decreasing air pressure within the lower region of the central opening 18 as one approaches the front edge 32 thereof. By adjusting the differential between the diameters of the smaller and larger apertures 78, the initial velocity of the stream of air, and the negative pressure drawn within the bottom channel 66 and side channels 68, 70, the forwardly biased pressure gradient will offset the relative pressure differential between the lower interior air pressure within the building and the higher exterior air pressures outside the building The forwardly biased pressure gradient may then be increased beyond this equilibrium point as desired.

As shown diagrammatically in FIG. 4, the result is to cause the stream of air being expelled through the outlet 64 in a generally linear path or vector to ramp or curl forwardly toward the front edge 32 of the central opening 18 as that stream of air traverses the central opening 18 in a downward direction, the degree of ramping or curling of the stream of air increasing as the stream of air nears and then enters the lower region of the central opening 18. This forward ramping or curling of the stream of air within the central opening 18 will propel airborne particles and contaminants outwardly or away from the front edge 32 of the central opening 18, as well as preventing those particles or contaminants from entering or mixing with the stream of moving air. In the example of the drive through service window 12, this outward ramping effect has proven very effective in repelling exhaust fumes, bugs, rain, and snow which would otherwise be blown or drawn through the window 12 to where an employee or worker was standing adjacent to the rear of the interior counter surface 76.

It may be readily appreciated that there will be some minimum differential between the size of the larger and smaller apertures 78 that must be utilized to reach an equilibrium between the interior and exterior pressures, offset the localized Bernoulli effect in the areas closely adjacent to the apertures 78, and to additionally create an effective ramping of the stream of air across the entire depth and width of the central opening 18. This differential will depend on the number and spacing of the apertures 78 in each row, the number and spacing of the rows of apertures 78, the relative pressure differential between the interior and exterior of the building, the negative pressure that can be effectively maintained within the bottom channel 66 and side channels 68, 70, the initial velocity of the stream of air as it leaves the outlet 64, as well as the height, width, and depth of the central opening 18.

Referring to FIGS. 2 and 3, it may be seen that the array of apertures 78 preferably forms a plurality of generally parallel rows, each row being formed by a plurality of apertures 78 of similar diameter. The apertures 78 within each row may be staggered relative to the apertures 78 in adjacent rows, the degree of stagger being either uniform or non-uniform. A generally uniform stagger which presents lines of dissimilar sized apertures 78 oriented at an angle of between 30° and 60° relative to the front and rear edges 32, 34 of the central opening 18 is shown in FIGS. 2 and 3. Referring particularly to FIGS. 1 and 3, it may be seen that the apertures 78 positioned at the top of each vertical row along the inner surfaces of the opposing side frame members 28, 30 thereby form a similar angle relative to the front and rear edges 32, 34 of the central opening 18, and present a peak in the array of apertures 78 along each of the opposing side frame members 28, 30. By having the peak or upper end line of angled apertures 78 disposed adjacent to the row of apertures 78 of greatest diameter, the ramping or curling of the air curtain will be maximized by further accentuating the forward bias of the pressure gradient at the top of the lower region of the central opening.

Referring again to FIGS. 1, 4, and 5, it may be seen that air drawn from the central opening 18 through the apertures 78 and into the bottom channel 66 or side channels 68, 70 will be carried upwardly through the side channels 68, 70 and into the pair of air return passages 50 of the duct 38. The air will traverse rearwardly through the air return passages 50 on opposing sides of the air flow passage 48, and be drawn through one of the two opposing side openings 52 in the the blower housing 36. The air will pass through one of a pair of opposing filter elements 80 within the blower housing 36 to remove dust or other particulate matter, and be drawn through the air intakes 42 of the blower 40 and expelled through the blower outlet 44 and into the air flow passage 48 to be completely recirculated through the apparatus for producing an air curtain 10 as described above.

Referring particularly to FIGS. 4 and 5, it may be seen that the blower housing 36 should be equipped with an easily removable access door 82 secured by wingnuts 84 or other suitable fasteners and disposed near the rear of the apparatus 10. Removal of the access door 82 should permit convenient access to the blower 40, the filter elements 80, and the openings or passages 52, 54 to the duct 38. The filter elements 80 are preferably removably mounted in frames 85 which prevent the passage of air from the exterior sides of the filter elements 80 to the interior sides thereof except through the filter elements 80 themselves Consequently, a vacuum or pressure gauge 86 capable of measuring the internal pressure or vacuum within the blower housing 36 disposed on the interior sides of the filter elements 80 will responsively register a change in acceptable pressure or vacuum when the filter elements 80 become dirty, clogged, or otherwise obstructed and need to be cleaned or replaced The blower 40 should be equipped with readily accessibly on-off controls 88, which may include a variable regulator for the blower 40, and an emergency shut-off. A heater 90 may also be utilized to preheat the air within the blower housing 36, thereby producing an air curtain of heated air to keep the doors 20 and central opening 18 warmed to a comfortable temperature. In environments such as a fast-food restaurant where the interior air can become saturated with grease and exhaust fumes, any heater 90 which is utilized should be constructed to prevent the possibility of sparks or combustion, one suitable alternative being an electrically excited ceramic heating element.

In this example, the window structure 12 presents directions of access on both sides of the air curtain (i.e., a tunnel having a predetermined depth rather than an whole or partial enclosure having only one direction of access.) With a tunnel of relatively short depth, on the order of a few inches in the case of the window structure 12, a single apparatus for producing a single air curtain 10 will generally be sufficient. A tunnel of greater length may in some cases require a pair of apparatuses for producing a pair of air curtains 10, each disposed at opposite ends of the tunnel and oriented in opposite directions, in order to satisfactorily maintain the integrity of the environment within the tunnel.

EXAMPLE 2

Instrument Enclosure

Referring particularly to FIGS. 6–10, the apparatus for producing an air curtain 10 is shown being utilized in connection with an enclosure 100 for an electronic instrument 102 such as a microprocessor or laboratory analytical device which must be protected from dust or other particles or contaminants, or which must be operated in a clean or sterile environment.

It may be appreciated that while the service window structure 12 discussed in Example 1 above is mounted in a building which itself forms an enclosure, the user is disposed on the interior side of the air curtain rather than the exterior side. In this example of an enclosure 100 for an instrument 102, the user will generally be disposed on the exterior side of the air curtain rather than the interior side.

For clarity and consistency, all reference numerals for various components of the apparatus for producing an air curtain 10 common to both the instrument enclosure embodiment of FIGS. 6–10 and the drive-through window structure embodiment of FIGS. 1–5 have been maintained the same wherever possible.

Figure 7:
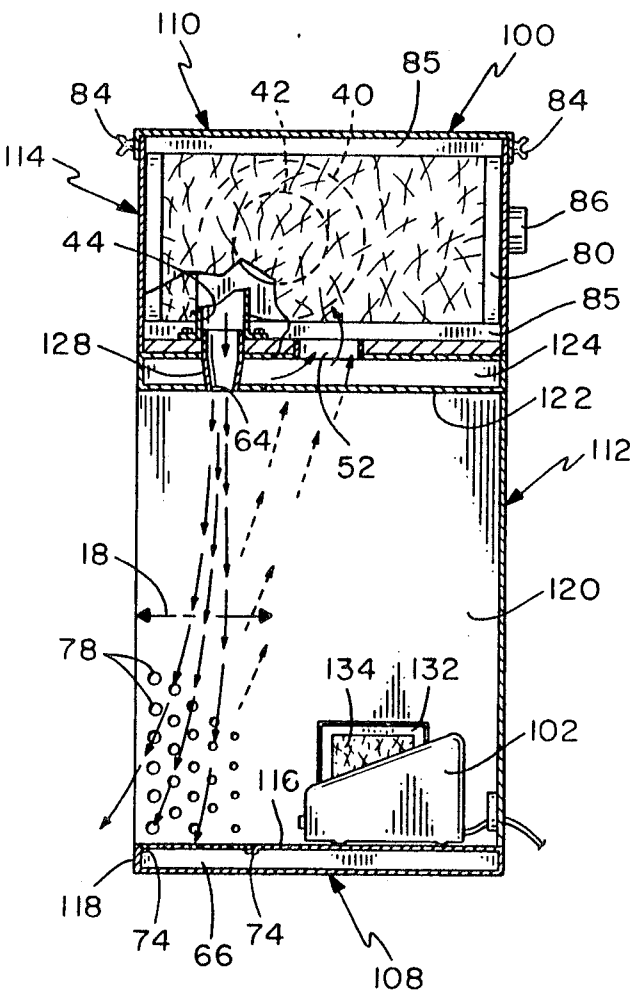
FIG. 7 is a side section view of the apparatus for producing an air curtain of FIG. 6 taken through line 7—7 of FIG. 6.
Figure 6:
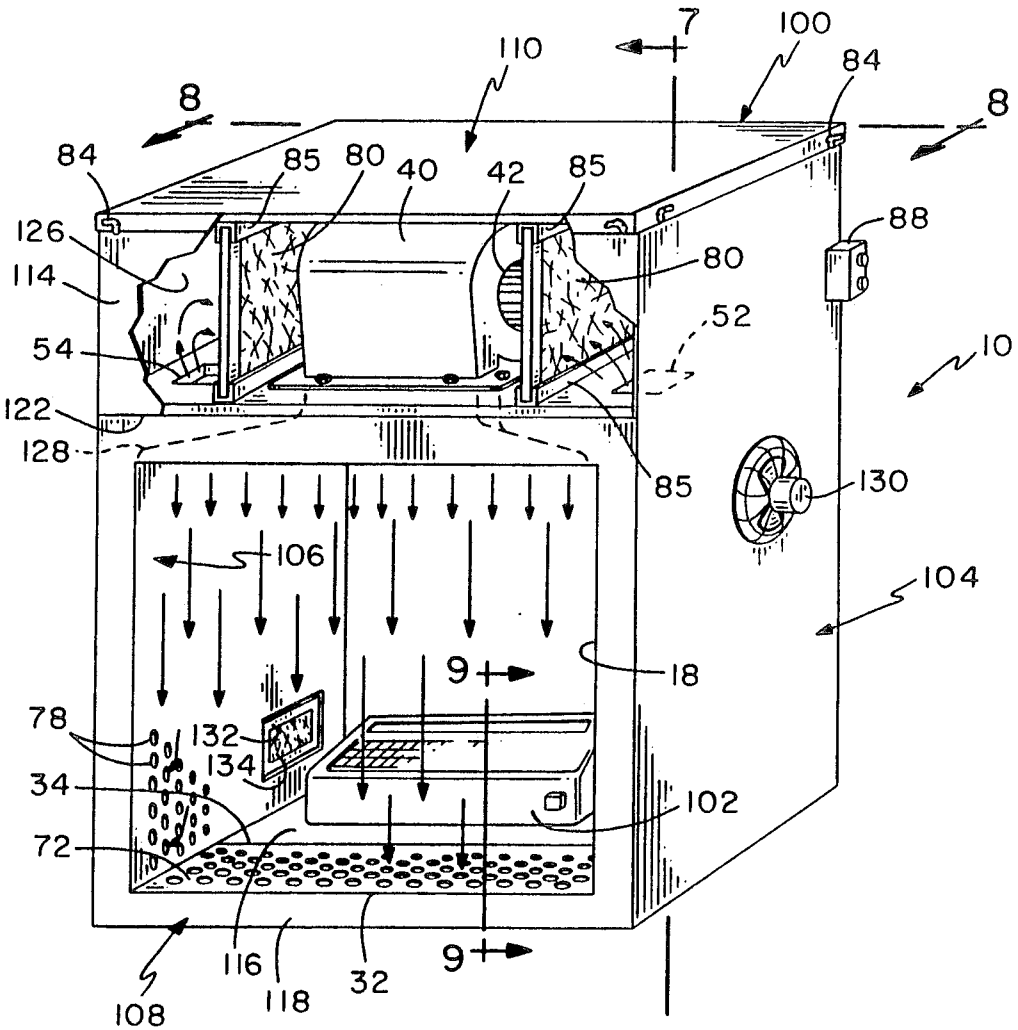
FIG. 6 is a front perspective view of the apparatus for producing an air curtain of this invention utilized in a computer terminal enclosure.

Referring to FIGS. 6 and 7, it may be seen that the enclosure 100 includes a pair of side walls 104, 106, a bottom wall 108, a top panel 110, a rear panel 112, and a partial front panel 114 which are connected together along their adjacent edges to form a generally parallelapiped-shaped enclosure. The partial front panel 114, side walls 104, 106, and bottom wall 108, or some lesser combination thereof, define a central opening 18 having a height, a width, and a depth.

The bottom wall 108 is hollow and defines a bottom channel 66 and a generally rectangular top support surface 116, and the side walls 104, 106 are each hollow and define side channels 68, 70, respectively. The bottom channel 66 is connected to and fluidly communicates with each of the side channels 68, 70 at the junctures between the bottom wall 108 and side walls 104, 106. The support surface 116 defines a generally rectangular opening adjacent to the front edge 118 of the bottom wall 108 which may similarly be covered by a recessed plate 72 which is supported on rails or flanges 74 connected to and extending around the peripheral edge of the rectangular opening so that the plate 72 may be easily lifted from the bottom wall 108. The recessed plate 72 is generally flush with the surrounding support surface 116.

The open area disposed above the support surface 116 and bounded by the side walls 104, 106, rear wall 112, and front edge 118 of the bottom wall 108 comprises an interior region 120. The interior region 120 therefore includes the central opening 18 to the extent of the depth of the central opening 18, and extends rearwardly from the rear edge 34 of the central opening 18 to the rear wall 112.

Disposed above the interior region 120 and central opening 18 is a generally horizontal hollow roof wall 122, the roof wall 122 defining a top channel 124. The top panel 110, rear panel 112, front panel 114, side walls 104, 106, and roof wall 122 enclose a blower housing area 126 within which is positioned a blower 40. The blower 40 similarly has an air intake 42 on each of the opposing sides, and a centrally disposed blower outlet 44. The depending blower outlet 44 of the blower 40 is operatively connected to and fluidly communicates with a generally vertical tapered or flared duct 128 which extends downwardly into or through the top channel 124 of the roof wall 122. The blower housing area 126 is similarly operatively connected to and fluidly communicates with the top channel 124 of the roof wall 122 along two opposing side portions thereof via two opposing side openings 52 in the bottom of the blower housing area 126 and top surface of the roof wall 122.

In operation, air expelled from the blower 40 through the blower outlet 44 into the flared duct 128 travels downwardly through the flared duct 128 to a point directly above or adjacent to the bottom surface of the roof wall 122 and situated adjacent to the rear edge 34 of the central opening 18. The air is forcibly expelled downward through an outlet 64 in the form of one or more slots, nozzles, or apertures defined by the bottom of the flared duct 128, the outlet 64 closely confronting and facing the central opening 18. The outlet 64 is constructed in any conventional manner to direct the stream of air downwardly in a generally linear vertical direction or vector, and is preferably aligned parallel with and disposed along or closely adjacent to the rear edge 34 of the central opening 18.

Figure 9:
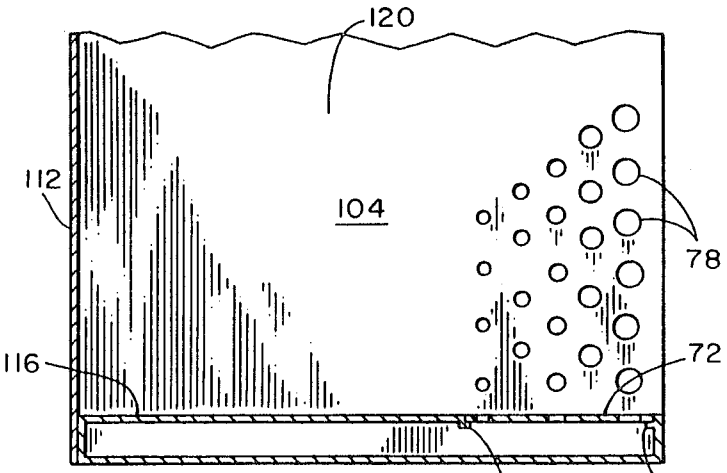
FIG. 9 is a partial section view of the bottom channel and one side channel of the apparatus for producing an air curtain of FIG. 6 taken through line 9—9 of FIG. 6.
Figure 10:
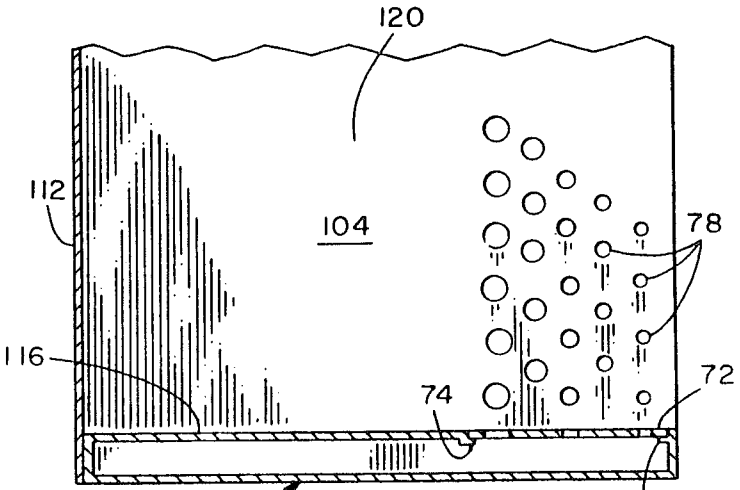
FIG. 10 is a partial section view of the bottom channel and one side channel of the apparatus for producing an air curtain of FIG. 6 taken through line 9-9 of FIG. 6, wherein the orientation of the array of apertures has been reversed.
Figure 8:
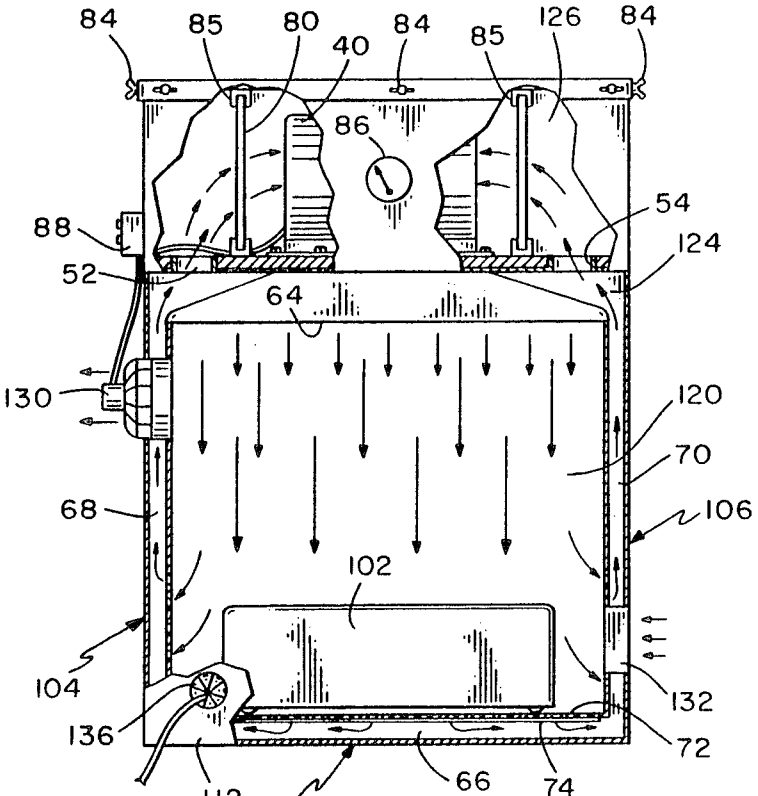
FIG. 8 is a partially broken away rear view of the apparatus for producing an air curtain of FIG. 6 taken from line 8—8 of FIG. 8.
Figure 12:
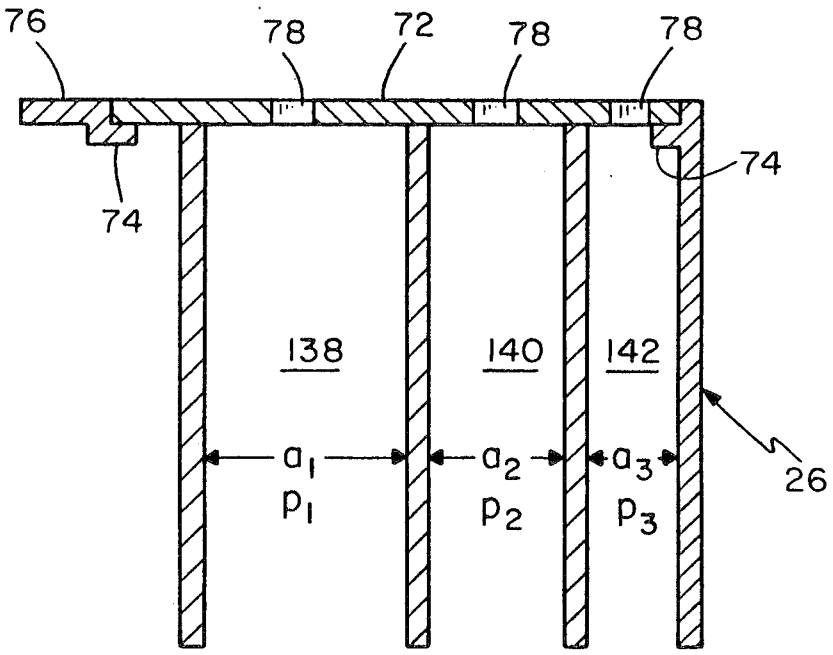
FIG. 12 is a side section view of an alternate embodiment of the apparatus for producing an air curtain of this invention showing the apertures in the plate and the bottom channels.

Referring particularly to FIGS. 6, 7, and 9, it may be seen that the plate 72 or support surface 116 and the inner surfaces of the side walls 104, 106 along the lower portions thereof each define a plurality of apertures 78 disposed within a zone generally confined between the front edge 32 and back edge 34 of the central opening 18, the central opening 18 thereby defining a lower region which is substantially bounded on its sides and bottom by a plurality of apertures 78, that lower region extending upwardly generally to the height of the highest apertures 78 along the side walls 104, 106. The apertures 78 similarly have varying diameters and are arranged or disposed in an array whereby rows of apertures 78 generally parallel with and more closely proximate to the front edge 32 of the central opening 18 have diameters greater than the diameters of the apertures 78 in rows parallel to and more closely proximate to the rear edge 34 of the central opening 18.

The array of increasing diameter apertures 78 will similarly produce a forwardly biased pressure gradient of progressively increasing draw rate and correspondingly decreasing air pressure within the lower region of the central opening 18 as one approaches the front edge 32 thereof As shown diagrammatically in FIG. 7, the result is to cause the stream of air being expelled through the outlet 64 in a generally linear path or vector to ramp or curl forwardly toward the front edge 32 of the central opening 18 as that stream of air traverses the central opening 18 in a downward direction. The degree of ramping or curling of the stream of air again increases as the stream of air nears and then traverses the lower region of the central opening 18, and the forward ramping or curling of the stream of air within the central opening 18 will prevent particles or contaminants from entering the interior region 120 but will permit a user to reach their arms or hands through the air curtain within the central opening 18 to operate the instrument 102.

Air from the central opening 18 drawn through the apertures 78 will be recirculated through the bottom channel 66 and side channels 68, 70 to the top channel 124, and upwardly through the opposing side openings 52, 54 of the roof wall 122 and into the blower housing area 126. The air will pass through one of a pair of opposing filter elements 80 within the blower housing area 126, and be drawn through the air intakes 42 of the blower 40 and expelled through the blower outlet 44 and into the flared duct 128 to be completely recirculated through the apparatus for producing an air curtain 10 as described above.

For an instrument 102 which produces a significant amount of heat which must be dissipated, such as a CPU, the temperature within the interior region 120 of the enclosure 100 may be controlled using a fan 130 and an inlet vent 132 equipped with a filter element 134 for providing circulation of the ambient air surrounding the instrument 102. Other means suitable for regulating the environment of the interior region 120 of the enclosure 100 may be utilized as appropriate. The enclosure should also be equipped with a relatively air-tight portal 136 for cords and wiring, such as a rubber iris gasket.

Again, the top panel 110 (or back panel 112) of the blower housing area 126 should be fashioned to provide an easily removable access door secured by wingnuts 84. Removal of the top panel 110 should permit convenient access to the blower 40, the filter elements 80, and the openings or passages 52, 54 to the top channel 124 and the flared duct 128. The filter elements 80 are similarly removably mounted in frames 85 which prevent the passage of air from the exterior sides of the filter elements 80 to the interior sides thereof except through the filter elements 80 themselves. A vacuum or pressure gauge 86 measuring the internal pressure or vacuum within the blower housing area 126 will register a change in acceptable pressure or vacuum when the filter elements 80 become dirty or clogged and need to be cleaned or replaced The blower 40 and fan 130 should be equipped with readily accessible on-off controls 88, which may include a variable regulator for the blower 40, separate controls for the fan 130, and an emergency shut-off.

In the case of the enclosure 100 for instruments 102 described above, it is assumed that the enclosure 100 may be maintained at a slight to moderate negative pressure due to ventilation by the fan 130 or other ventilation means The enclosure 100 could be placed within a negative pressure environment, and the controlled environment within the enclosure 100 could be maintained at a strong negative pressure (a negative-negative pressure) to preserve a sterile interior environment. However, in some types of negative pressure laboratory settings it may be necessary to maintain a positive pressure controlled environment within the enclosure 100 and maintain some level of sterility within the enclosure 100. In such a case, the orientation of the array of apertures 78 in the plate 72 or bottom wall 108 and the side walls 104, 106 may be reversed, such that the larger apertures 78 are disposed more proximate to the inner or rear edge 34 of the central opening 18, and the smaller apertures 78 are disposed more proximate to the outer or front edge 32 of the central opening 18. As a result, the ramping or curling of the air will be directed inwardly toward the interior region 120 of the enclosure 100, and will thereby oppose both the negative exterior atmospheric pressure and the positive interior pressure within the enclosure 100. This orientation of the apertures 78 is shown particularly in FIG. 10.

While it has been described in relation to the preferred embodiments that the apertures 78 be disposed in an array of rows generally parallel with the front and rear edges 32, 34 of the central opening 18 with apertures 78 of varying diameter, it should be appreciated that the apertures 78 need not be positioned in uniform rows, that the apertures 78 in any one row be of the same diameter or shape, nor that apertures 78 of different or varying diameters actually be used. The important functional characteristic is that the apertures 78 be arranged in an array whereby the average cross-sectional area of a first group of one or more apertures 78 in a particular area is greater than the average cross-sectional area of a second group of one or more apertures 78, with the first group of apertures 78 being disposed more closely proximate to the edge 32, 34 toward which the stream of air in the air curtain 10 is being ramped or curled, ad further that for the air curtain 10 as a whole the aggregated groups of apertures 78 conform to this same general proposition.

It may be appreciated that an equivalent result may be obtained in other ways which may be less desirable due to the increased cost or complexity required to design, manufacture, or maintain those systems compared to the preferred embodiments discussed above.

For example, by utilizing uniformly sized apertures 78 with air being drawn through various rows or sections of the apertures 78 at varying rates depending upon the proximity of the particular row of apertures 78 to the front edge 32 of the central opening 18, the same ramping effect can be created. However, it can easily be appreciated that such a system would require that individual rows or sections of apertures 78 be individually connected to independently partitioned channels 138, 140, 142 of varying cross-sectional areas a1, a2, a3, or which are coupled to independent sources for drawing the air at varying rates or different pressures p1, p2, p3, as exemplified diagrammatically in FIG. 12.

Figure 11:
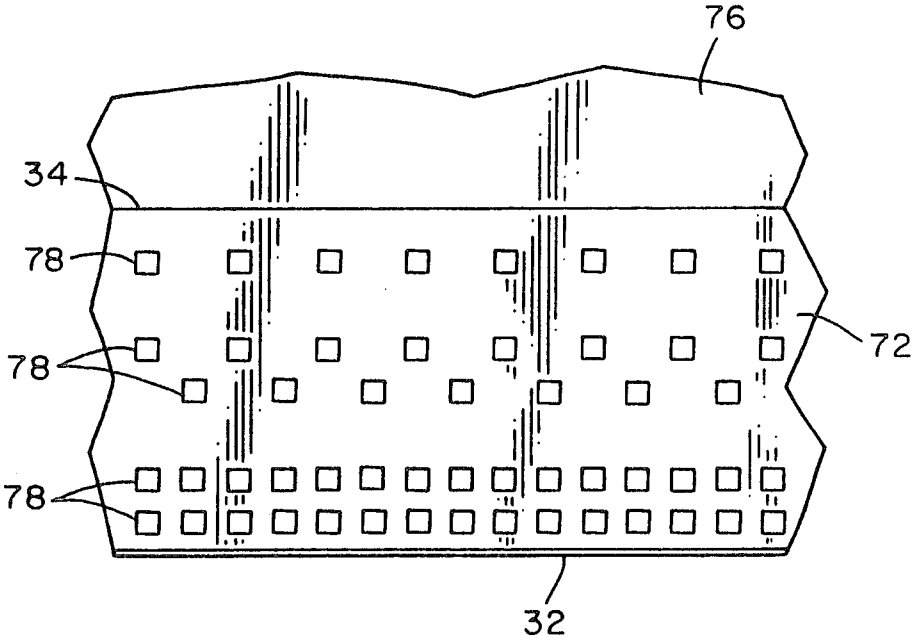
FIG. 11 is a top plan view of an alternate embodiment of the apparatus for producing an air curtain of this invention showing the apertures in the plate.

Another alternative, represented diagrammatically in FIG. 11, is to utilize apertures 78 of uniform or identical size, shape, or cross-sectional area, but to vary the density or number of apertures 78 per unit area in a manner which similarly creates a pressure gradient across the depth of the central opening 18 by increasing the total amount of air drawn through the region or zone of apertures 78 more closely proximate to one of the edges 32, 34 of the central opening 18 toward which the air is being ramped or curled. Finally, it may be appreciated that any one or more of the available design alternatives discussed above may be utilized in combination to produce an optimal result in a particular application.

It may be further appreciated that in some applications the apparatus for producing an air curtain 10 of this invention may be configured such that the stream of air will traverse the central opening 18 in a direction from the bottom frame 26 to the top frame 24, or alternately from one of the opposing sides 28, 30 to the other opposing side 30, 28. In each of these cases, as with a conventional configuration where the stream of air traverses the central opening 18 from the top frame 24 to the bottom frame 26, the stream of air may be said to traverse the central opening 18 between any pair of opposing sides thereof.

Similarly, while the preferred embodiments of the above apparatus for producing a ramped air curtain 10 have been described in detail above with reference to the attached drawing Figures, it is understood that various other changes, modifications, and adaptations may be made in the apparatus for producing a ramped air curtain 10 or its numerous applications or embodiments without departing from the spirit and scope of the appended claims.

What is claimed is:

1. An apparatus for producing an air curtain across a central opening, said central opening having a front edge and a rear edge, a top, a bottom, and a pair of opposing sides, said apparatus for producing an air curtain comprising:

a top frame extending along the top side of the central opening substantially between the open sides thereof, said top frame defining a top channel and an air outlet, said air outlet facing generally downward toward the central opening and fluidly communicating with said top channel;

a bottom frame extending along the bottom of the central opening substantially between the opposing sides thereof, said bottom frame having a top surface disposed facing generally upward toward the central opening, said bottom frame defining a bottom channel, said top surface defining a plurality of bottom apertures extending therethrough ad fluidly communicating with said bottom channel, said plurality of apertures being disposed between the front edge and the rear edge of the central opening; and a blower, said blower having at least one blower outlet and at least one blower intake, said blower being capable of blowing air under pressure from said blower outlet and drawing air into said blower intake, said blower outlet being operatively connected to and fluidly communicating with said air outlet in said top frame such that a stream of air is expelled downwardly from said air outlet in a generally linear direction traversing the central opening, said blower intake being operatively connected to and fluidly communicating with said bottom channel and said plurality of bottom apertures such that said stream of air traversing the central opening is drawn into said bottom channel through said plurality of bottom apertures, said plurality of bottom apertures being arranged such that a greater volume of air per unit time is drawn though a first portion of said plurality of bottom apertures disposed more closely proximate to the front edge of the central opening than is drawn through a second portion of said plurality of bottom apertures disposed more closely proximate to the rear edge of the central opening due to the apertures disposed more closely proximate to the front edge having a greater area and number than the apertures disposed closer to the rear, whereby the stream of air being expelled through the air outlet in the generally linear direction will ramp or curl forwardly toward the front edge of the central opening as that stream of air traverses the central opening due to the effect of the air being drawn through the plurality of bottom apertures.

2. The apparatus for producing an air curtain of claim 1 wherein each of the plurality of bottom apertures has a cross sectional area, said cross sectional area of each of the plurality of bottom apertures in the first portion being greater than said cross sectional area of each of the plurality of bottom apertures in the second portion.

3. The apparatus for producing an air curtain of claim 1 wherein each of the plurality of bottom apertures is generally circular and has a diameter, said diameter of each of the plurality of bottom apertures in the first portion being greater than said diameter of each of the plurality of bottom apertures in the second portion.

4. The apparatus for producing an air curtain of claim 1 wherein each of the plurality of bottom apertures has a cross sectional area and is disposed in a plurality of rows, each of said plurality of rows being oriented generally parallel with the front edge of the central opening, such that the cross sectional area of each of the plurality of bottom apertures in a first row more closely proximate to the front edge of the central opening has a cross sectional area greater than said cross sectional area of each of the plurality of bottom apertures in a second row more closely proximate to the rear edge of the central opening.

5. The apparatus for producing an air curtain of claim 1 wherein the air outlet is disposed more closely adjacent to the rear edge of the central opening.

6. The apparatus for producing an air curtain of claim 1 further comprising:

at least one side frame extending along at least one of the pair of opposing sides of the central opening substantially from the bottom to the top thereof, said side frame being connected to the bottom frame and defining a side channel fluidly communicating with said bottom channel, said side frame having an inner surface disposed facing generally inward toward the central opening, said inner surface further defining a plurality of side apertures extending therethrough and fluidly communicating with said side channel, said plurality of side apertures being disposed along at least a lower region of said side frame between the front edge and the rear edge of the central opening, the blower intake being operatively connected to and fluidly communicating with said side channel and said plurality of side apertures such that the stream of air traversing the central opening is drawn into said side channel through said plurality of side apertures, said plurality of side apertures being arranged such that a greater volume of air per unit time is drawn though a first side portion of said plurality of side apertures disposed more closely proximate to the front edge of the central opening than is drawn through a second side portion of said plurality of side apertures disposed more closely proximate to the rear edge of the central opening, whereby the stream of air being expelled through the air outlet in the generally linear direction will ramp or curl forwardly toward the front edge of the central opening as that stream of air traverses the central opening.

7. The apparatus for producing an air curtain of claim 6 wherein the plurality of side apertures are confined within the lower region of the side frame, the lower region of the side frame extending upwardly from the bottom frame to not more than one half the height of the central opening.

8. The apparatus for producing an air curtain of claim 6 whereby air drawn through the plurality of bottom apertures into the bottom channel is drawn from the bottom channel into and through the side channel to the blower intake.

9. The apparatus for producing an air curtain of claim 6 wherein each of the plurality of side apertures has a cross sectional area, said cross sectional area of each of the plurality of side apertures in the first side portion being greater than said cross sectional area of each of the plurality of side apertures in the second side portion.

10. The apparatus for producing an air curtain of claim 6 wherein each of the plurality of side apertures is generally circular and has a diameter, said diameter of each of the plurality of side apertures in the first side portion being greater than said diameter of each of the plurality of side apertures in the second side portion.

11. The apparatus for producing an air curtain of claim 6 wherein each of the plurality of side apertures has a cross sectional area and is disposed in a plurality of side rows, each of said plurality of side rows being oriented generally parallel with the front edge of the central opening, such that the cross sectional area of each of the plurality of side apertures in a first side row more closely proximate to the front edge of the central opening has a cross sectional area greater than said cross sectional area of each of the plurality of side apertures in a second side row more closely proximate to the rear edge of the central opening.

12. The apparatus for producing an air curtain of claim 6 wherein the number of side frames is two, each of the side frames being disposed on one of the opposing sides of the central opening and connected to the bottom frame, the side channel of each of the side frames fluidly communicating with the bottom channel, the plurality of side apertures extending through the inner surfaces of each of the side frames fluidly communicating with each of the side channels, the blower intake being operatively connected to and fluidly communicating with each of the side channels such that air drawn through the plurality of bottom apertures into the bottom channel is drawn from the bottom channel into and through the side channels to the blower intake.

13. The apparatus for producing an air curtain of claim 12 further comprising:

at least one duct, said duct defining an air flow passage and a pair of air return passages, said duct being operatively connected to and fluidly communicating with the blower outlet and the air outlet such that air expelled by the blower outlet will flow through said air flow passage to the air outlet, said duct being operatively connected to and fluidly communicating with the blower intake and each of the side channels such that air drawn into the side channels will flow through said pair of air return passages to the blower intake.

14. The apparatus for producing an air curtain of claim 13 wherein the duct is partitioned to define both the air flow passage and the pair of air return passages.

15. The apparatus for producing an air curtain of claim 14 wherein the air flow passage is disposed between the pair of air return passages.

16. The apparatus for producing an air curtain of claim 13 further comprising:

a blower housing, said blower housing substantially enclosing the blower and being operatively connected to and fluidly communicating with the air flow passage and the pair of air return passages.

17. The apparatus for producing an air curtain of claim 16 wherein the blower housing further encloses a filter means, said filter means being disposed between the pair of air return passages and the blower intake and including at least one filter element, whereby substantially all of the air being drawn from the pair of air return passages into the blower intake must pass through said filter element.

18. The apparatus for producing an air curtain of claim 17 wherein the number of blower intakes is two, each of the blower intakes being disposed on one of two opposing sides of the blower, and wherein the number of filter elements is two, each of the filter elements being disposed on one of said two opposing sides of the blower.

19. The apparatus for producing an air curtain of claim 17 wherein the blower housing includes a means for measuring the pressure within the blower housing adjacent to the blower intake, said means for measuring the pressure within the blower housing adjacent to the blower intake being capable of responsively register a change in pressure within the blower housing adjacent to the blower intake caused by the filter element becoming obstructed.

20. The apparatus for producing an air curtain of claim 1 further comprising:

at least one duct, said duct defining an air flow passage and an air return passage, said duct being operatively connected to and fluidly communicating with the blower outlet and the air outlet such that air expelled by the blower outlet will flow through said air flow passage to the air outlet, said duct being operatively connected to and fluidly communicating with the blower intake and the side channel such that air drawn into the side channel will flow through said air return passage to the blower intake.

21. The apparatus for producing an air curtain of claim 20 wherein the duct is partitioned to define both the air flow passage and the air return passage.

22. The apparatus for producing an air curtain of claim 21 wherein the air flow passage is disposed at least partially within the air return passage.

23. The apparatus for producing an air curtain of claim 20 further comprising:

a blower housing, said blower housing substantially enclosing the blower and being operatively connected to and fluidly communicating with the air flow passage and the air return passage.

24. The apparatus for producing an air curtain of claim 23 wherein the blower housing further encloses a filter means, said filter means being disposed between the air return passage and the blower intake and including at least one filter element, whereby substantially all of the air being drawn from the air return passage into the blower intake must pass through said filter element.

25. The apparatus for producing an air curtain of claim 24 wherein the blower housing includes a means for measuring the pressure within the blower housing adjacent to the blower intake, said means for measuring the pressure within the blower housing adjacent to the blower intake being capable of responsively indicating a change in pressure within the blower housing adjacent to the blower intake caused by the filter element becoming obstructed.

26. An apparatus for producing an air curtain across a central opening in an access way such as a drive-through service window, said central opening having a front edge and a rear edge, a top, a bottom, and a pair of opposing sides, said apparatus for producing an air curtain comprising:

a top frame extending along the top of the central opening substantially between the pair of opposing sides thereof, said top frame defining an air outlet facing generally downward toward the central opening;

a bottom frame extending along the bottom of the central opening substantially between the pair of opposing sides thereof, said bottom frame having a top surface disposed facing generally upward toward the central opening, said bottom frame defining a bottom channel therein, said top surface defining a plurality of bottom apertures extending therethrough and fluidly communicating with said bottom channel;

at least one side frame extending along at least one of the pair of opposing sides of the central opening substantially from the bottom to the top thereof, said side frame fuming connected to said bottom frame and defining an side channel therein, said side channel fluidly communicating with said bottom channel a duct, said duct having an air flow passage an air return passage, said air flow passage being operatively connected to and fluidly communicating with said air outlet, said air outlet, said air return passage being operatively connected to and fluidly communicating with said side channel; and a blower, said blower having a blower intake and a blower outlet, said blower outlet being operatively connected to and fluidly communicating with said air flow passage, said blower inlet being operatively connected to and fluidly communicating with said air return passage, said plurality of bottom apertures being arranged such that a greater volume of air per unit time is drawn though a first portion of said plurality of bottom apertures disposed mare closely proximate to the front edge of the central opening than is drawn through a second portion of said plurality of bottom apertures disposed mare closely proximate to the rear edge of the central opening, whereby air is expelled by the blower from the blower outlet and through the flow passage of the duct, and is expelled downwardly as a stream of air from the air outlet in a generally linear direction central opening, said stream of air generally curving from the rear edge toward the front edge of the central opening as said stream of air traverses the central opening due to said stream of air being drawn into the bottom channel through the plurality of bottom apertures, said stream of air being recirculated to the blower through the bottom channel, the side channel, the air return passage, and the blower intake.

27. The apparatus for producing an air curtain of claim 26 wherein each of the plurality of bottom apertures has a cross sectional area, said cross sectional area of each of the plurality of bottom apertures in the first portion being greater than said cross sectional area of each of the plurality of bottom apertures in the second portion.

28. The apparatus for producing an air curtain of claim 27 wherein each of the plurality of bottom apertures is generally circular and has a diameter, said diameter of each of the plurality of bottom apertures in the first portion being greater than said diameter of each of the plurality of bottom apertures in the second portion.

29. The apparatus for producing an air curtain of claim 27 wherein each of the plurality of bottom apertures has a cross sectional area and is disposed in a plurality of rows, each of said plurality of rows being oriented generally parallel with the front edge of the central opening, such that the cross sectional area of each of the plurality of bottom apertures in a first row more closely proximate to the front edge of the central opening has a cross sectional area greater than said cross sectional area of each of the plurality of bottom apertures in a second row more closely proximate to the rear edge of the central opening.

30. The apparatus for producing an air curtain of claim 26 wherein the side frame has an inner surface disposed facing generally inwardly toward the central opening, said apparatus for producing an air curtain further comprising:

a plurality of side apertures defined by the side frame and extending therethrough and fluidly communicating with said side channel, said plurality of side apertures being arranged such that a greater volume of air per unit time is drawn though a first side portion of said plurality of side apertures disposed more closely proximate to the front edge of the central opening than is drawn through a second side portion of said plurality of side apertures disposed more closely proximate to the rear edge of the central opening.

31. The apparatus for producing an air curtain of claim 30 wherein the central opening has a height and wherein the plurality of side apertures are confined within a lower region of the side frame, said lower region of the side frame extending upwardly from the bottom frame to not more than one half said height of the central opening.

32. The apparatus for producing an air curtain of claim 30 wherein each of the plurality of side apertures has a cross sectional area, said cross sectional area of each of the plurality of side apertures in the first side portion being greater than said cross sectional area of each of the plurality of side apertures in the second side portion.

33. The apparatus for producing an air curtain of claim 30 wherein each of the plurality of side apertures is generally circular and has a diameter, said diameter of each of the plurality of side apertures in the first side portion being greater than said diameter of each of the plurality of side apertures in the second side portion.

34. The apparatus for producing an air curtain of claim 30 wherein each of the plurality of side apertures has a cross sectional area and is disposed in a plurality of side rows, each of said plurality of side rows being oriented generally parallel with the front edge of the central opening, such that the cross sectional area of each of the plurality of side apertures in a first side row more closely proximate to the front edge of the central opening has a cross sectional area greater than said cross sectional area of each of the plurality of side apertures in a second side row more closely proximate to the rear edge of the central opening.

35. An apparatus for producing an air curtain across a central opening, said central opening having a first edge and a second edge and a depth measured therebetween, a top, a bottom, and a pair of opposing sides, said apparatus for producing an air curtain comprising:

a top frame extending along the top of the central opening substantially between the pair of opposing sides thereof, said top frame defining an air outlet facing generally downward toward the central opening;

a bottom frame extending along the bottom of the central opening substantially between the pair of opposing sides thereof, said bottom frame having a top surface disposed facing generally upward toward the central opening, said bottom frame defining a bottom channel therein, said top surface defining a plurality of bottom apertures extending therethrough and fluidly communicating with said bottom channel, said plurality of bottom apertures being generally uniform in cross sectional area and arranged such that a first density of said plurality of bottom apertures located with a first zone disposed more closely proximate to the first edge of the central opening is greater than a second density of said plurality of bottom apertures located with a second zone disposed ore closely proximate to the second edge of the central opening, at least one side frame extending along at least one of the of opposing sides of the central opening substantially from the bottom to the top thereof, said side frame being connected to said bottom frame and defining an side channel therein, said side channel fluidly communicating with said bottom channel;

a duct, said duct having an air flow passage an air return passage, said air flaw passage being operatively connected to and fluidly communicating with said air outlet, said air return passage being operatively connected to and fluidly communicating with said side channel blower, said blower having a blower intake and a blower outlet, said blower outlet being operatively connected to and fluidly communicating with said air flow passage, said blower inlet being operatively connected to and fluidly communicating with said air return passage, whereby air is expelled downwardly as a stream of air from the air outlet in a generally linear direction traversing the central opening, said stream of air generally ramping or curving from the second edge toward the first edge of the central opening as said stream of air traverses the central opening due to the stream of air being drawn through the plurality of bottom apertures.

36. The apparatus for producing an air curtain of claim 35 wherein the side frame has an inner surface disposed facing generally inwardly toward the central opening, said apparatus for producing an air curtain further comprising:

a plurality of side apertures defined by the side frame and extending therethrough and fluidly communicating with said side channel, said plurality of side apertures being generally uniform in cross sectional area and arranged such that a first density of said plurality of side apertures located within a first zone disposed more closely proximate to the first edge of the central opening is greater than a second density of said plurality of side apertures located within a second zone disposed more closely proximate to the second edge of the central opening.

37. An apparatus for producing an air curtain across a central opening, said central opening having a front edge and a rear edge, a top, a bottom, and a pair of opposing sides, said apparatus for producing an air curtain comprising:

a top frame extending along the top side of the central opening substantially between the pair of opposing sides thereof, said top frame defining an air outlet, said air outlet facing generally downward toward the central opening;

a bottom frame extending along the bottom of the central opening substantially between the pair of opposing sides thereof, said bottom frame having a surface disposed facing generally upward toward the central opening, said bottom frame defining a bottom channel, said surface defining a plurality of apertures extending therethrough and fluidly communicating with said bottom channel;

a blower, said blower having at least one blower outlet and at least one blower intake, said blower being capable of blowing air under pressure from said blower outlet, said blower outlet being operatively connected to and fluidly communicating with said air outlet in said top frame such that a stream of air is expelled downwardly from said air outlet in a generally linear direction traversing the central opening, said stream of air traversing the central opening being drawn into said bottom channel through said plurality of apertures, said plurality of apertures being arranged such that a greater volume of air per unit time is drawn though a first portion of said plurality of apertures disposed more closely proximate to the rear edge of the central opening than is drawn through a second portion of said plurality of apertures disposed more closely proximate to the front edge of the central opening due to the apertures disposed ore closely proximate to the front edge having a greater area and number than the apertures disposed closer to the rear, whereby the stream of air being expelled through the air outlet in a generally linear direction will ramp or curl rearwardly toward the rear edge of the central opening as that stream of air traverses the central opening due to the stream of air being drawn through said plurality of apertures.

38. The apparatus for producing an air curtain of claim 37 wherein each of the plurality of bottom apertures has a cross sectional area, said cross sectional area of each of the plurality of bottom apertures in the first portion being greater than said cross sectional area of each of the plurality of bottom apertures in the second portion.

39. The apparatus for producing an air curtain of claim 37 wherein each of the plurality of bottom apertures is generally circular and has a diameter, said diameter of each of the plurality of bottom apertures in the first portion being greater than said diameter of each of the plurality of bottom apertures in the second portion.

40. The apparatus for producing an air curtain of claim 37 wherein each of the plurality of bottom apertures has a cross sectional area and is disposed in a plurality of rows, each of said plurality of rows being oriented generally parallel with the front edge of the central opening, such that the cross sectional area of each of the plurality of bottom apertures in a first row more closely proximate to the front edge of the central opening has a cross sectional area greater than said cross sectional area of each of the plurality of bottom apertures in a second row more closely proximate to the rear edge of the central opening.

41. The apparatus for producing an air curtain of claim 37 wherein the air outlet is disposed more closely adjacent to the front edge of the central opening.

42. An apparatus for producing an air curtain across a central opening, said central opening having a height and a width and a depth, said central opening further having a pair of opposing edges between which is measured said depth of said central opening, said apparatus for producing an air curtain comprising:

a first frame extending along a side of the central opening, said first frame defining an air outlet, said air outlet facing generally toward the central opening;

a second frame extending along a second side of the central opening opposing said first side, said second frame having a surface disposed facing generally toward the central opening, said surface defining a plurality of apertures extending therethrough;

a blower, said blower having at least one blower outlet and at least one blower intake, said blower being capable of blowing air under pressure from said blower outlet and drawing air into said blower intake, said blower outlet being operatively connected to and fluidly communicating with said air outlet such that a stream of air is expelled from said air outlet in a generally linear direction traversing the central opening, said blower intake being operatively connected to and fluidly communicating with said plurality of apertures such that said stream of air traversing the central opening is drawn through said plurality of apertures, said plurality of apertures being arranged such that a greater volume of air per unit time is drawn though a first portion of said plurality of apertures disposed more closely proximate to a first one of the pair of apposing edges of the central opening than is drawn through a second portion of said plurality of apertures disposed more closely proximate to a second one of the pair of opposing edges of the central opening due to the apertures disposed more closely proximate to the front edge having a greater area and number than the apertures disposed closer to the rear, whereby the stream of air being expelled through the air outlet in a generally linear direction will ramp or curl toward the first one of the pair of apposing edges of the central opening as that stream of air traverses the central opening due to the stream of air being drawn through the plurality of apertures.

43. The apparatus for producing an air curtain of claim 42 wherein the plurality of apertures in the first portion have a first combined cross sectional area, the plurality of apertures in the second portion have a second combined cross sectional area, said first combined cross sectional area being greater than said second combined cross sectional area.

44. The apparatus for producing an air curtain of claim 42 wherein each of the plurality of apertures is generally circular and has a diameter, said diameter of each of the plurality of apertures in the first portion being greater than said diameter of each of the plurality of apertures in the second portion.

45. The apparatus for producing an air curtain of claim 42 wherein each of the plurality of apertures is disposed in a plurality of rows, each of said plurality of rows being oriented generally parallel with the front edge of the central opening, such that a first combined cross sectional area of the plurality of apertures in a first row more closely proximate to the first edge of the central opening is greater than a second combined cross sectional area of the plurality of apertures in a second row more closely proximate to the second edge of the central opening.

46. The apparatus for producing an air curtain of claim 42 wherein the air outlet is disposed more closely adjacent to the second edge of the central opening.

47. In a partial enclosure in which an instrument may be placed, said partial enclosure including a bottom wall, a top wall, a pair of opposing side walls, and a back wall, with said bottom wall, said top wall, said pair of opposing side walls, and said back wall being connected together and defining an interior region into which said instrument is placed and a central opening through which said instrument may be accessed by a user, said central opening having a first edge and a second edge and a depth measured therebetween, a top, a bottom, and a pair of opposing sides, the improvement comprising:

a bottom frame extending along the bottom of the central opening substantially between the pair of opposing sides thereof, said bottom frame having a surface disposed facing generally upward toward the central opening, said bottom frame defining a bottom channel, said surface defining a plurality of bottom apertures extending therethrough and fluidly communicating with said bottom channel;

a top frame extending along the top of the central opening and defining an air outlet, said air outlet facing generally downward toward the central opening;

a blower, said blower having at least one blower outlet and at least one blower intake, said blower being capable of blowing air under pressure from said blower outlet, said blower outlet being operatively connected to and fluidly communicating with said air outlet in said top frame such that a stream of air is expelled downwardly from said air outlet in a generally linear direction traversing the central opening, said stream of air traversing the central opening being drawn into said bottom channel through said plurality of bottom apertures, said plurality of bottom apertures being arranged such that a greater volume of air per unit time is drawn though a first portion of said plurality of bottom apertures disposed more closely proximate to the first edge of the central opening than is drawn through a second portion of said plurality of bottom apertures disposed more closely proximate to the second edge of the central opening, due to the apertures disposed more closely proximate to the front edge having a greater area and number than the apertures disposed closer to the rear, whereby the stream of air being expelled through the air outlet in a generally linear direction will ramp or curl toward the first edge of the central opening as that stream of air traverses the central opening due to the stream of air being drawn through the plurality of bottom apertures.

48. The partial enclosure of claim 47 wherein each of the plurality of bottom apertures has a cross sectional area, said cross sectional area of each of the plurality of bottom apertures in the first portion being greater than said cross sectional area of each of the plurality of bottom apertures in the second portion.

49. The partial enclosure of claim 47 wherein each of the plurality of bottom apertures is generally circular and has a diameter, said diameter of each of the plurality of bottom apertures in the first portion being greater than said diameter of each of the plurality of bottom apertures in the second portion

50. The partial enclosure of claim 47 wherein each of the plurality of bottom apertures has a cross sectional area and is disposed in a plurality of rows, each of said plurality of rows being oriented generally parallel with the first edge of the central opening, such that the cross sectional area of each of the plurality of bottom apertures in a first row more closely proximate to the first edge of the central opening has a cross sectional area greater than said cross sectional area of each of the plurality of bottom apertures in a second row more closely proximate to the second edge of the central opening.

51. The partial enclosure of claim 47 wherein the air outlet is disposed more closely adjacent to the first edge of the central opening.

52. The partial enclosure of claim 51 wherein the central opening has a front edge and a rear edge, the first edge of the central opening being said front edge and the second edge of the central opening being said rear edge.

53. The partial enclosure of claim 51 wherein the central opening has a front edge and a rear edge, the first edge of the central opening being said rear edge and the second edge of the central opening being said front edge.

54. The partial enclosure of claim 47 further comprising:

at least one side frame extending along at least one of the pair of opposing sides of the central opening substantially from the bottom to the top thereof, said side frame being connected to the bottom frame and defining a side channel fluidly communicating with said bottom channel, said side frame having an inner surface disposed facing generally inward toward the central opening, said inner surface further defining a plurality of side apertures extending therethrough and fluidly communicating with said side channel, said plurality of side apertures being disposed between the first edge and the second edge of the central opening, the blower intake being operatively connected to and fluidly communicating with said side channel and said plurality of side apertures such that the stream of air traversing the central opening is drawn into said side channel through said plurality of side apertures, said plurality of side apertures being arranged such that a greater volume of air per unit time is drawn though a first side portion of said plurality of side apertures disposed more closely proximate to the first edge of the central opening than is drawn through a second side portion of said plurality of side apertures disposed more closely proximate to the second edge of the central opening, whereby the stream of air being expelled through the air outlet in the generally linear direction will ramp or curl forwardly toward the first edge of the central opening as that stream of air traverses the central opening.

55. The partial enclosure of claim 54 wherein the side frame has a lower region, the plurality of side apertures being confined within said lower region of the side frame, said lower region of the side frame extending upwardly from the bottom frame to not more than one half the height of the central opening.

56. The partial enclosure of claim 54 whereby air drawn through the plurality of bottom apertures into the bottom channel is drawn from the bottom channel into and through the side channel to the blower intake.

57. The partial enclosure of claim 54 wherein each of the plurality of side apertures has a cross sectional area, said cross sectional area of each of the plurality of side apertures in the first side portion being greater than said cross sectional area of each of the plurality of side apertures in the second side portion.

58. The partial enclosure of claim 54 wherein each of the plurality of side apertures is generally circular and has a diameter, said diameter of each of the plurality of side apertures in the first side portion being greater than said diameter of each of the plurality of side apertures in the second side portion.

59. The partial enclosure of claim 54 wherein each of the plurality of side apertures has a cross sectional area and is disposed in a plurality of side rows, each of said plurality of side rows being oriented generally parallel with the front edge of the central opening, such that the cross sectional area of each of the plurality of side apertures in a first side row more closely proximate to the first edge of the central opening has a cross sectional area greater than said cross sectional area of each of the plurality of side apertures in a second side row more closely proximate to the second edge of the central opening.

60. A method for producing a ramped air curtain across a central opening, said central opening having a top, a bottom, a pair of opposing sides, a first edge, and a second edge, said central opening having a height and a width and a depth, said depth being measured between said first edge and said second edge, said method for producing a ramped air curtain comprising the steps of:

providing the central opening with an air outlet disposed adjacent to the top of the central opening;

providing the central opening with a bottom frame disposed adjacent to the bottom of the central opening, said bottom frame defining a plurality of apertures extending therethrough, said plurality of apertures being configured such that a first portion of the plurality of apertures each have a first area and a second portion of the plurality of apertures each have a second area, said first area being generally greater than said second area, said first area being more closely proximate to the first edge than to the second edge;

expelling a stream of air downwardly from said air outlet in a generally linear direction such that said steam of air traverses the central opening; and drawing said stream of air through said plurality of apertures such that a greater volume of air per unit time is drawn though said first portion of said plurality of apertures than is drawn through said second portion of said plurality of apertures to produce the ramped air curtain.

61. A method for producing a ramped air curtain across a central opening, said central opening having a pair of opposing sides, a first edge, and a second edgar said central opening having a height and a width and a depth, aid depth being measured between said first edge and said second edge, said method for producing a ramped air curtain comprising the steps of:

providing the central opening with an air outlet disposed adjacent to a first one of the pair of opposing sides of the central opening;

providing the central opening with a frame, said frame being said frame defining a plurality of apertures extending therethrough, said plurality of apertures being configured such that a first portion of the plurality of apertures each have a first area and a second portion of the plurality of apertures each have a second area, said first area being generally greater than said second area, said first area being more closely proximate to the first edge than to the second edge;

expelling a stream of air from said air outlet in a generally linear direction such that said steam of air traverses the central opening; and drawing said stream of air through said plurality of apertures such that a greater volume of air per unit time is drawn through said first portion of said plurality of apertures than is drawn through said second portion of said pluraltiy of apertures to produce the ramped air curtain.

62. A method for producing a ramped air curtain across a central opening, said central opening having a pair of opposing sides, a first edge, and a second edge, said central opening having a height and a width and a depth, aid depth being measured between said first edge and said second edge, said method for producing a ramped air curtain comprising the steps of:

providing the central opening with an air outlet disposed adjacent to a first one of the pair of opposing sides of the central opening;

providing the central opening with a frame, said frame being disposed on a second one of the pair of opposing sides, said frame defining a plurality of apertures extending therethrough, said plurality of apertures being configured such that a first portion of said plurality of apertures is disposed more closely proximate to the first edge of the central opening and a second portion of said plurality of apertures is disposed more closely proximate to the second edge of the central opening, said plurality of apertures in said first portion having a first combined cross sectional area, said plurality of apertures in said second portion having a second combined cross sectional area, said first combined cross sectional being greater than said second combined cross sectional area;

expelling a stream of air from said air outlet in a generally linear direction such that said steam of air traverses the central opening; and drawing said stream of air through said plurality of apertures such that a greater volume of air per unit time is drawn though said first portion of said plurality of apertures than is drawn through said second portion of said plurality of apertures to produce the ramped air curtain.

* * * * *